US005428362A

United States Patent [19]

Chatzipetros et al.

[11] Patent Number: 5,428,362

[45] Date of Patent: Jun. 27, 1995

[54] SUBSTRATE INTEGRATED ANTENNA

[75] Inventors: Argyrios Chatzipetros, Plantation; Paul Marko, Ft. Lauderdale; Paul Krayeski, Plantation, all of Fla.

[73] Assignee: Motorola, Inc., Schaumburg, Ill.

[21] Appl. No.: 192,529

[22] Filed: Feb. 7, 1994

[51] Int. Cl.[6] ..... H01Q 1/24

[52] U.S. Cl. ..... 343/702; 343/853; 343/700 MS

[58] Field of Search ..... 343/702, 700 MS, 749, 343/752, 850, 853, 841, 857; 455/89, 90; H01Q 1/24

[56] References Cited

U.S. PATENT DOCUMENTS 4,847,626 7/1989 Kahler et al. ..... 343/700 MS
5,349,364 9/1994 Bryanos et al. ..... 343/770

FOREIGN PATENT DOCUMENTS 0246026 11/1987 European Pat. Off. ..... H01Q 1/24
56-134804 10/1981 Japan ..... 343/700 MS
59-169207 9/1984 Japan ..... 343/700 MS
3-9602 1/1991 Japan ..... H01Q 1/24

*Primary Examiner*—Donald Hajec
*Assistant Examiner*—Hoanganh Le
*Attorney, Agent, or Firm*—Daniel K. Nichols

[57] ABSTRACT

An antenna (110), enclosed within a compact area of a radio (100), is not susceptible to electric fields generated from metallic shields (102, 104) located within the radio. The antenna consists of four sections of traces disposed onto a circuit board (108). The first section is a quarter-wave feed (202), which is coupled to a radio transceiver (118). The quarter-wave feed (202) converts a low impedance point (122) to a high impedance region (203). The second section of antenna (110) capacitively couples to the high impedance region (203). The third section is an isolator section (208) of half a wavelength for providing isolation from the shields (102, 104). The fourth section, quarter-wavelength radiator (214), is a trace electrically equivalent to a quarter of a wavelength having a high impedance and providing the radiating port of the antenna (110).

12 Claims, 3 Drawing Sheets

SUBSTRATE INTEGRATED ANTENNA

TECHNICAL FIELD

This invention relates to radio communication systems and more specifically to antennas for radio communication systems.

BACKGROUND

Personal communications systems products such as Second Generation Cordless Telephone (CT-2) employ a large number of base stations in order to provide a wide area of service coverage. In the past, the antennas for these base stations have typically comprised of either internal or external dipole antennas. For the purposes of down sizing the base station and for ergonomic reasons the antenna has been incorporated into the base station housing using an antenna. By enclosing the antenna within the housing a problem arises with the effect of the electric fields generated from the metallic shields that cover the circuit boards within the housing. The close proximity of the antenna to the metallic shields causes distortion of the antenna radiation pattern. Such distortion is typically reduced by moving the radiating elements of the antenna away from the metallic surface but due to the physical constraints of the housing this option is not available. There is a need for an optimum antenna design that will fit in a confined space and not be greatly affected by the metallic shields while ensuring that the antenna is easy to manufacture and cost efficient.

DETAILED DESCRIPTION OF THE PREFERRED EMBODIMENT

Figure 1:
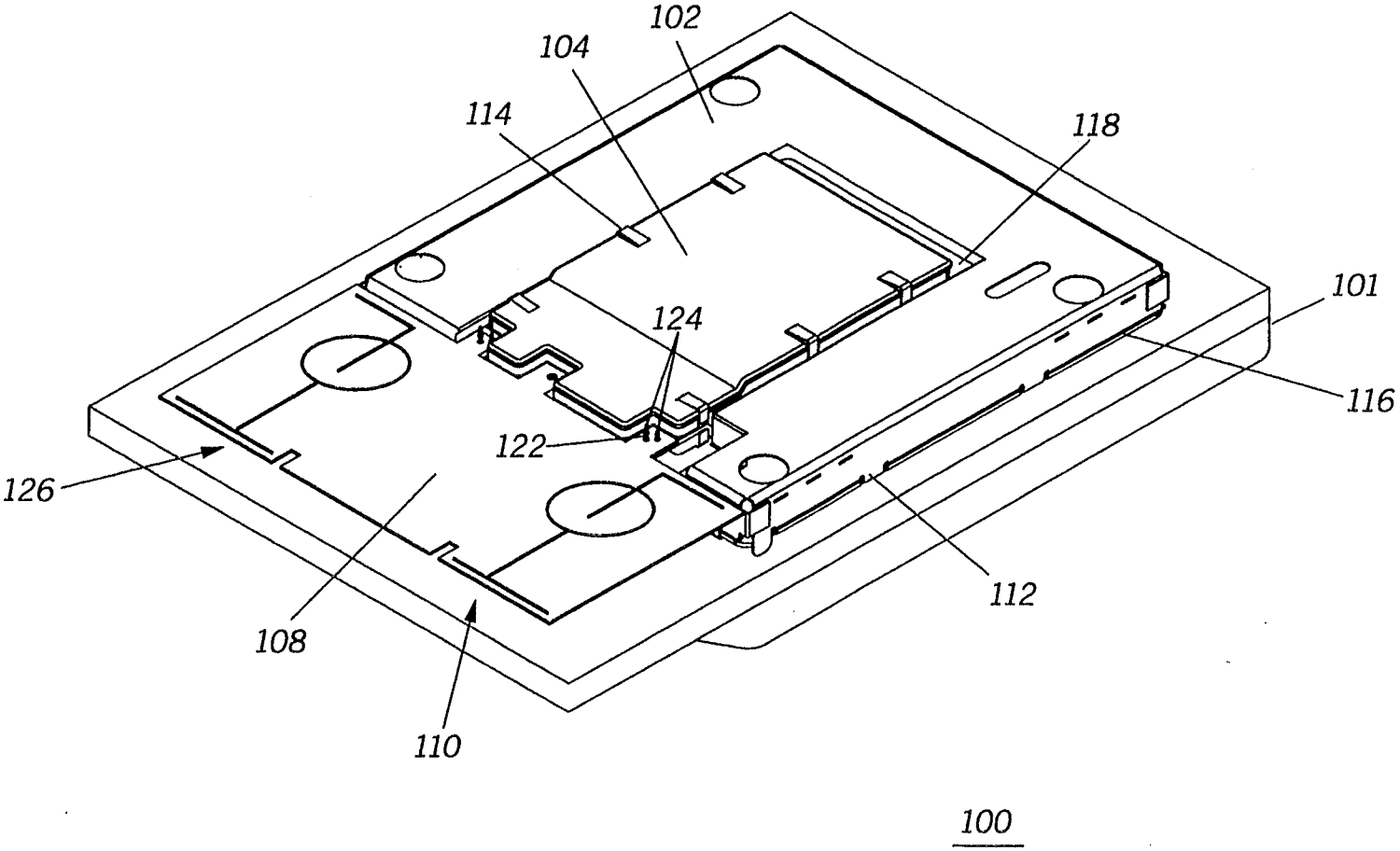
FIG. 1 shows a drawing of a radio in accordance with the present invention.

A radio 100, such as a CT-2 base station, is shown in FIG. 1 of the accompanying drawings. The base station 100 is comprised of a housing 101 which includes a controller board 116 covered by an outer perimeter controller shield 102. The controller shield 102 is attached to the controller board 116 by a series of ground (GND) clips 112 to provide a ground plane to the shield. The base station also includes a transceiver board 118 mated to the controller board 116 within the perimeter of the controller shield 102 through a multi-pin connector (not shown). The transceiver board 118 is covered by a radio frequency (RF) shield 104 having a series of GND clips 114 that mate the RF shield to the ground of the controller shield 102. The compact CT-2 public base stations require two antennas 110 and 126, for the purpose of diversity, confined in a space of 3.5 inches (8.9 cm) by 7 inches (17.8 cm) located at the top of the metallic shields 102 and 104 within the housing 101. While the drawings show two substantially identical antennas, 110 and 126, disposed on a substrate 108, only one antenna 110 will be described by the invention.

The transceiver board 118 includes two sets of substantially identical contacts, one set for antenna 110 and the other set for antenna 126. Only one set of contacts, the set for antenna 110, will be described by the invention. The set of contacts for antenna 110 includes three contact sockets (not shown) located on the transceiver board 118, one as an RF socket for transmitting or receiving an RF signal and the other two as mechanical sockets for providing a means of mechanical support to the substrate 108 connected to the top portion of the transceiver board. The RF socket provides an electrical contact between the transceiver board 118 and the antenna 110 contained within the substrate 108 for transmitting or receiving an RF signal. The substrate 108 includes corresponding antenna feed point 122 and mechanical feed points 124 to mate with the RF socket and mechanical sockets. In the preferred embodiment of the invention, the antenna feed point 122 and mechanical feed points 124 are antenna feed pin 122 and mechanical feed pins 124 respectively. Antenna feed pin 122 mates to the RF socket forming an electrical contact between the transceiver board 118 and the antenna 110 while mechanical feed pins 124 mate to the mechanical sockets to maintain the mechanical support for the substrate 108 once connected to the transceiver board 118. The antenna feed pin 122 is a low impedance point of approximately 50 ohms when mated to the transceiver board 118 at the RF socket. The impedance of antenna 110 is affected by surrounding metallic objects so matching of the antenna is typically done with the antenna located at the top end of the shields 102 and 104.

Figure 2:
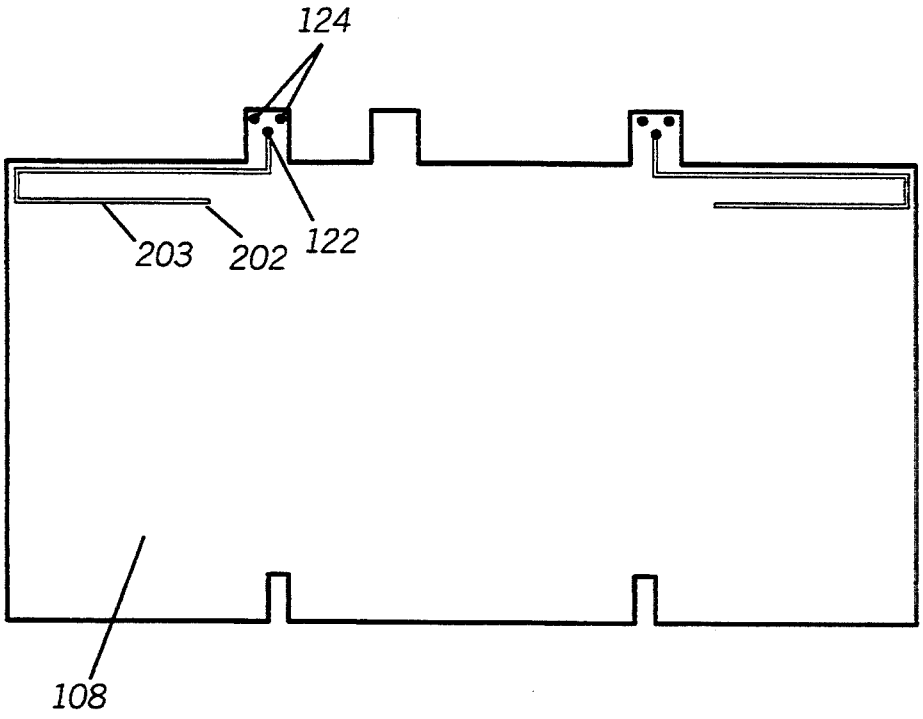
FIG. 2 shows a drawing of a first surface of an antenna in accordance with the present invention.
Figure 3:
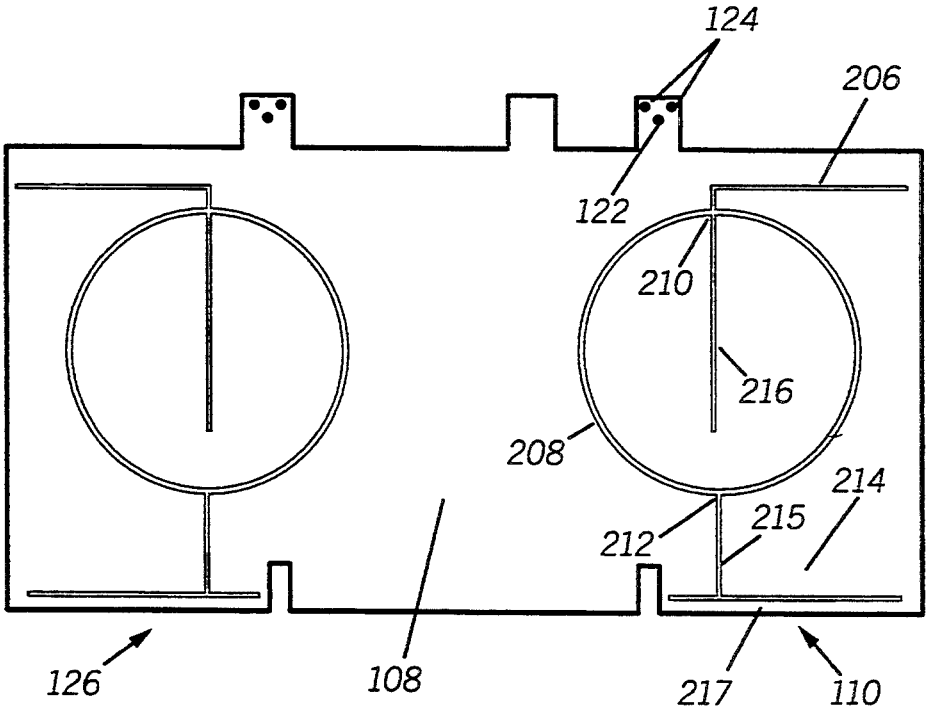
FIG. 3 shows a drawing of a second surface of an antenna in accordance with the present invention.

As shown in FIG. 2 and FIG. 3, the antenna 110 is located within non-conductive substrate 108 having two opposing surfaces. By printing traces of a conductive material, such as copper or gold, onto the substrate 108, the antenna 110 is formed. The substrate 108, in the preferred embodiment, comprises a printed circuit board of fire retarding glass epoxy material (FR4) having dielectric constant 4.7 and thickness of 31 mils (0.79 mm). The antenna 110 includes a feed section for providing the RF signal. In the preferred embodiment of the present invention, the feed section comprises the antenna feed pin 122, located on the first surface of substrate 108, a quarter-wave feed section 202 and a coupling section 206, both located on the second surface of the substrate. The substrate 108 contains antenna feed pin 122 for coupling to the RF socket, located within transceiver board 118, and also for coupling to the first end of the quarter-wave feed 202. The quarter-wave feed 202 is formed from a meandered trace of 70 mils (1.78 mm) width and 3650 mils (9.27 cm) length that starts at antenna feed pin 122 and converts the low impedance point located at antenna feed pin 122 to a first high impedance region 203 along the top section of the trace 202. The first high impedance region 203 is then capacitively coupled through the board 108 to coupling section 206 on the opposing side of the board. The first high impedance region 203 is substantially in register with the coupling section 206. In the preferred embodiment, this capacitive coupling is achieved by locating the high impedance region 203 of the quarter-wave feed 202 directly underneath the coupling section 206 on the opposite side of the board 108.

The coupling section 206 is fed into-an isolator means, which in the preferred embodiment comprises a substantially circular loop. 208, having a perimeter of approximately half a Wavelength and located on the second surface of the substrate 108. The circular loop 208 includes a first feed point 210 coupled to the coupling section 206, and a second feed point 212. In the preferred embodiment of the invention, the first feed point 210 and second feed point 212 are displaced approximately 180° opposite from each other within the circular loop 208. A quarter-wavelength radiator 214, located on the second surface of substrate 108 and coupled to the second feed point 212, provides a second high impedance region. The quarter-wavelength radiator 214 includes two sections, a vertical section 215 coupled to the second feed point 212 of the circular loop 208, and a horizontal top section 217 coupled to the vertical section. The quarter-wavelength radiator 214 is top loaded and provides an equivalent electrical distance of one quarter-wavelength. The circular loop 208 provides isolation between the first feed point 210 and the second feed point 212 thereby providing a reduction in the effects of the electric fields generated by the metallic shields 102 and 104 on the second high impedance region. The Circular loop 208 isolates, physically and electrically, the quarter-wavelength radiator 214 from shields 102, 104 and minimizes the distortion caused by the shields. Tuning of the antenna operating frequency is accomplished by selecting the appropriate length of the quarter-wavelength radiator 214. Antenna 110 uses quarter-wavelength radiator 214 to either transmit or receive an RF signal.

Within the area enclosed by the circular loop 208 is a tuning stub 216 extending from the first feed point 210 of the circular loop. The tuning stub 216 is used to fine-tune the impedance of the antenna 110 by selecting the appropriate length. The antenna 110 described by the invention is tuned for 866 mega-hertz (MHz) and has a bandwidth of approximately 60 MHz with a minimum return loss of 10 dB across the band.

The antenna 110 is formed by disposing the different sections of the antenna (antenna feed point 122, quarter-wave feed 202, coupling section 206, isolator means 208, tuning stub 216, and quarter-wavelength radiator 214) onto the substrate 108 as printed traces. The substrate material and layout of the printed circuit board used for manufacturing the antenna 110 is more easily manufactured than a coil style antenna that would comprise more mechanical parts. Repeatability of measurement is ensured by the inherent characteristics of the substrate material and the tolerance of the width of the traces. The antenna 110 transmits an average power approximately equal to that of a half-wavelength reference dipole antenna mounted to the same contact sockets, located on transceiver board 118, however the half-wavelength reference dipole antenna does not fit within housing 101.

Figure 4:
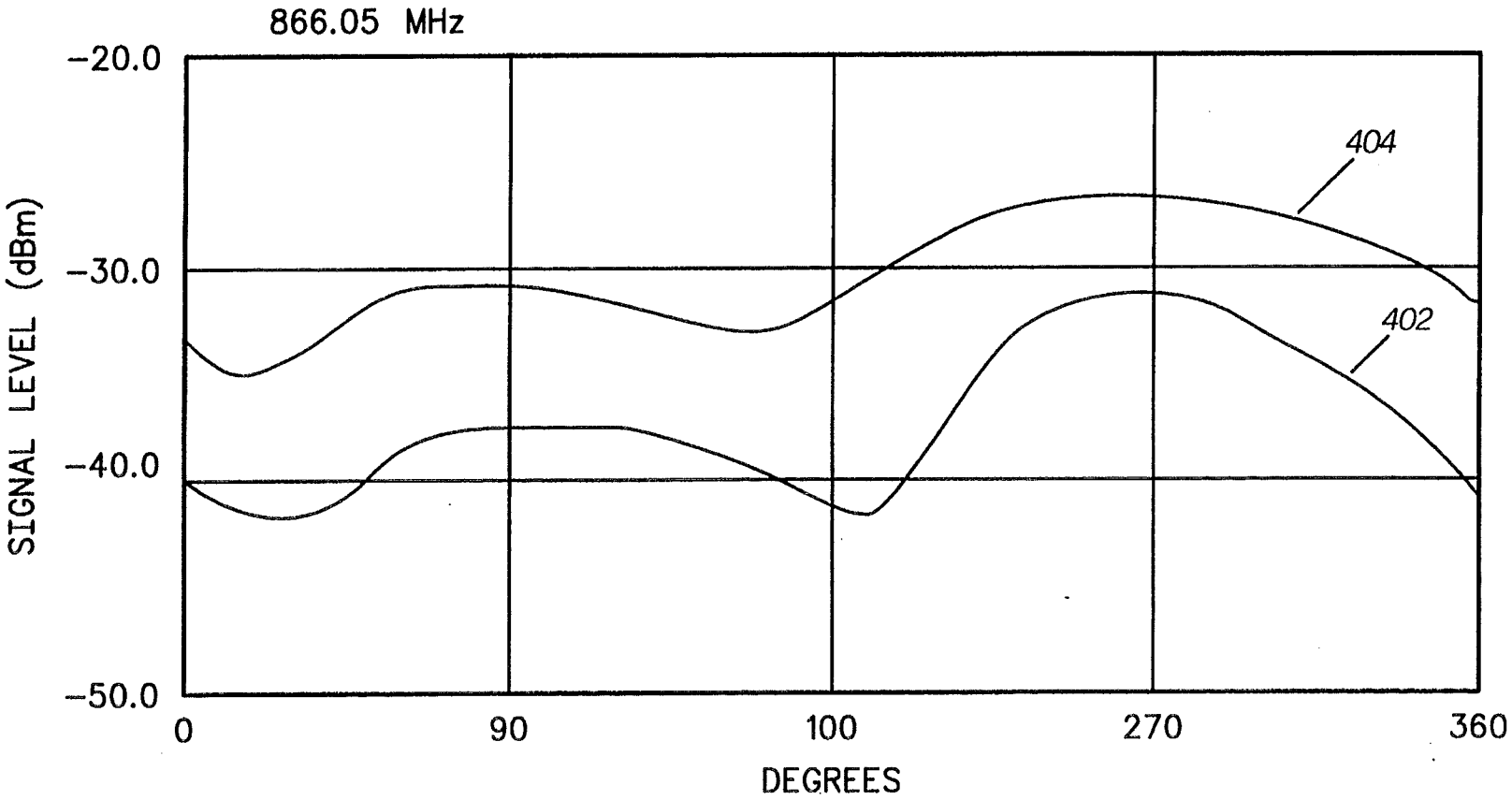
FIG. 4 shows a graph of radiation patterns comparing a standard quarter-wavelength stub antenna to the antenna as described by the present invention.

A graph comparing the radiation pattern of a standard quarter-wavelength stub antenna that fits inside the housing 101 and the antenna as described by the invention is shown in FIG. 4. The pattern 402 represents the matched quarter-wavelength stub antenna and pattern 404 represents the antenna 110. The patterns measured over 360° in azimuth show the quarter-wavelength stub having peaks and dips associated with having a high impedance point next to the shields. The antenna 110 with pattern 404 provides a more consistent pattern with less variation in the signal level as well as an overall increase in radiated power of approximately 4.4 dB.

It can be seen by the description given in the preferred embodiment that the invention could be applied in other fashions to achieve similar results. For instance, if space constraints were not rigid the capacitive coupling could be accomplished on one surface of the substrate 108 by running the feed section and the coupling section side by side and in parallel rather than on opposing surfaces. Also, the isolator means 208 could be formed by an elliptical radiator, such as an oval radiator, in order to achieve the half wavelength transfer. Other substrate materials could be used other than FR4 with trace width and board thickness adjusted for the dielectric constant of the material. If fine tuning of the impedance is not required the tuning stub 216 could be eliminated. A variety of different meandered line configurations could be employed to achieve the quarter-wave for the feed section and the quarter-wave radiator to accommodate various shapes and sizes of substrates.

Hence, the antenna 110 as described by the invention, has proven to be an effective means of providing an antenna which exhibits reduced radiation effects from shields held in close proximity to the antenna. This antenna 110 is easy to manufacture and excellent results can be obtained using inexpensive substrate materials.

What is claimed is:

1. An antenna, comprising:

a substrate;

a feed section, located on the substrate, for feeding an RF signal;

an isolator means having first and second feed points located on the substrate, the isolator means coupled to the feed section at the first feed point;

a quarter-wavelength radiator located on the substrate, the quarter-wavelength radiator coupled to the second feed point;

said isolator means being substantially circular; and wherein the substantially circular isolator means encloses an area and includes a tuning stub extending from the first feed point within said enclosed area.

2. An antenna as defined in claim 1, the feed section comprising:

an antenna feed point located on the substrate;

a quarter-wavelength feed located on the substrate, the quarter-wavelength feed coupled to the antenna feed point; and a coupling section located on the substrate, the coupling section capacitively coupled to the quarter-wavelength feed.

3. An antenna as defined in claim 2, wherein the substrate comprises first and second opposing surfaces;

the antenna feed point is located on the first surface of the substrate;

the quarter-wavelength feed is located on the first surface of the substrate; and the coupling section is located on the second surface of the substrate.

4. An antenna as defined in claim 3, wherein the isolator means is located on the second surface of the substrate.

5. An antenna as defined in claim 3, wherein the quarter-wavelength radiator is located on the second surface of the substrate.

6. An antenna as defined in claim 2, wherein the quarter-wavelength radiator is top loaded.

7. An antenna as defined in claim 2, wherein the substrate further comprises a printed circuit board.

8. An antenna as defined in claim 7, wherein the printed circuit board comprises fire retarding glass epoxy material.

9. An antenna comprising:

a substrate;

a quarter wavelength feed for providing a means for transforming a low impedance to a first high impedance;

a coupling section for providing capacitive coupling between the coupling section and the quarter wavelength feed;

an isolator means having first and second feed points, the first feed point coupled to the coupling section, the isolator means providing a means for isolating the first feed point from the second feed point; and a quarter-wavelength radiator coupled to the second feed point of the isolator means for transmitting or receiving an RF signal and providing a second high impedance.

10. An antenna as defined in claim 9, wherein the isolator means further comprises a matching stub extending from the first feed point of the isolator means for providing fine tuning of the impedance of the antenna.

11. A radio comprising:

a housing;

a transmitting device located within the housing, the transmitting device for transmitting an RF signal;

a shield located within the housing, the shield coupled to the transmitting device and generating electric fields;

a diversity antenna located within the housing and coupled to the transmitting device, the diversity antenna includes two substantially identical antennas each having:

a substrate having a first and second opposed surfaces;

an antenna feed point located on the first surface for receiving the RF signal;

a quarter-wavelength feed located on the first surface, the quarter-wavelength feed coupled to the antenna feed point;

a coupling section located on the second surface, the coupling section capacitively coupled to the quarter-wavelength feed;

an isolator means having first and second feed points located on the second surface, the isolator means coupled to the coupling section at the first feed point, the isolator means providing a reduction in the effects of the electric fields generated by the shield; and a quarter-wavelength radiator located on the second surface, the quarter-wavelength radiator coupled to the second feed point, the quarter-wavelength radiator transmitting the RF signal.

12. The radio as defined in claim 11 comprises a second generation cordless telephone base station.

* * * * *